US005975292A

United States Patent [19]

Sundara et al.

[11] Patent Number: 5,975,292

[45] Date of Patent: Nov. 2, 1999

[54] ASYMMETRICAL GOLF BAG

[75] Inventors: Chloe Helen Sundara, Mill Valley; Eric Penman Bogner; Bruce Anthony Janis, both of San Francisco, all of Calif.

[73] Assignee: Sundara Industries, Ltd., San Francisco, Calif.

[21] Appl. No.: 08/994,847

[22] Filed: Dec. 19, 1997

[51] Int. Cl.[6] ..... A63B 55/00

[52] U.S. Cl. ..... 206/315.3; 206/315.6; 206/315.7

[58] Field of Search ..... 206/315.3, 315.5, 206/315.7, 315.8, 315.6; 248/96; D3/255

[56] References Cited

U.S. PATENT DOCUMENTS

| | | | |
|---|---|---|---|
| D. 172,785 | 8/1954 | Eging | 206/315.3 X |
| D. 317,227 | 6/1991 | Fumia | D3/37 |
| D. 319,346 | 8/1991 | Jessen | D3/255 |
| D. 353,263 | 12/1994 | Danezin | D3/255 |
| D. 353,264 | 12/1994 | Danezin | D3/255 |
| D. 365,445 | 12/1995 | Boone | 206/315.1 |
| D. 374,989 | 10/1996 | LaPlante, Sr. | D3/320 |
| D. 385,113 | 10/1997 | Beck et al. | D3/320 |
| D. 385,421 | 10/1997 | MacDougall | D3/320 |
| 1,092,833 | 4/1914 | Grant | 206/315.3 X |
| 1,597,870 | 8/1926 | Reach | 206/315.6 |
| 1,680,354 | 8/1928 | Williams | 206/315.6 |
| 2,214,579 | 9/1940 | Delin | 248/96 X |
| 2,282,842 | 5/1942 | Abell | 248/96 X |
| 3,503,518 | 3/1970 | Black | 206/315.6 X |
| 4,995,510 | 2/1991 | Fletcher, Jr. | 206/315.6 |
| 5,339,951 | 8/1994 | Chen . | |
| 5,356,003 | 10/1994 | Gretz et al. | 206/315.7 |
| 5,361,899 | 11/1994 | Reimers | 206/315.7 |
| 5,415,284 | 5/1995 | King | 206/315.6 |
| 5,450,955 | 9/1995 | Olson | 206/315.3 X |
| 5,516,064 | 5/1996 | Hsieh | 248/96 |

*Primary Examiner*—Gary E. Elkins
*Assistant Examiner*—Tri Mai
*Attorney, Agent, or Firm*—Blakely, Sokoloff, Taylor & Zafman LLP

[57] ABSTRACT

An asymmetrical golf bag is provided. According to one aspect of the present invention, the golf bag includes a top located at an upper portion of the golf bag and a base located at a lower portion of the golf bag. Additionally, the golf bag additionally includes a body coupled between the top and the base. Further, a stand is mounted to the top and the base at an off center position. According to another aspect of the present invention, the top has an asymmetrical shape about two perpendicular axes. The asymmetrical top may additionally include a pair of corresponding halves defined by a longitudinal axis. The right half may have a convex shape designed to comfortably cradle the small of a golfer's back. The left half may have a concave shape to increase the volume of a pocket, such as a clothing pocket or a ball pocket. The asymmetrical top may additionally include one or more integral dividers. The dividers slope downward from the left half of the golf bag top to the right half to encourage the clubs to gather in a position close to the golfer's center of gravity when the golf bag is being carried. According to yet another aspect of the present invention, the base has an asymmetrical shape about two perpendicular axes. In addition, the base may include an off center, bi-planar cut away portion including two intersecting planes coupled by a radius to facilitate engagement of the off center mounted stand mechanism.

3 Claims, 9 Drawing Sheets

ASYMMETRICAL GOLF BAG

FIELD OF THE INVENTION

The invention relates generally to golf equipment. More particularly, the invention relates to stand bags.

BACKGROUND OF THE INVENTION

Existing golf bags designed for use as stand bags typically have symmetrical tops and bases and a stand mechanism that is mounted in a central position along the body. A top view of two exemplary prior art golf bag tops 105, 115 is shown in FIGS. 1A and 1B. Both golf bag tops 105, 115 have symmetric elliptical shapes. The golf bag tops 105, 115 each further include divider bars 110, 120 allowing a golfer to separate and organize his/her clubs.

Some disadvantages of prior golf bags are now briefly discussed with reference to FIGS. 2A and 2B. A golfer 200 is depicted carrying a golf bag 205 containing a set of clubs 210. Due to the nature of the divider bars 110, 120, which are typically parallel to the ground when the golf bag 205 is being carried, the clubs 210 often noisily slosh about as the golfer 200 is walking. Additionally, the motion of the clubs 210 may induce movement of the golf bag 205. The movement of the golf bag 205 may in turn cause the golf bag 205 to repeatedly strike the golfer's back as it swings out and returns. This repeated pounding may result in back discomfort 215 unless the golfer 205 can manage to hold the golf bag 205 steady. In view of the foregoing and other disadvantages of prior art stand bags, what is needed is an improved golf bag design.

SUMMARY OF THE INVENTION

An asymmetrical golf bag is described. According to one aspect of the present invention, the golf bag includes a top located at an upper portion of the golf bag through which golf clubs may be inserted and a base located at a lower portion of the golf bag to provide support for the golf clubs. A body is coupled between the top and the base. Additionally, the golf bag includes a stand mounted to the top and the base at an off center position.

According to a second aspect of the present invention, the golf bag top has an asymmetrical shape about two perpendicular axes. The asymmetrical top may additionally include a pair of corresponding halves defined by a longitudinal axis. The right half may have a convex shape sculpted to comfortably cradle the small of a golfer's back. The left half may have a concave shape designed to increase the volume of a pocket.

According to a third aspect of the present invention, the asymmetrical top includes one or more integral dividers. The dividers slope downward from the left half of the golf bag top to the right half thereby encouraging the clubs to gather in a position which will hold the golf bag snug against the golfer's back when the golf bag is being carried.

According a fourth aspect of the present invention, the golf bag base has an asymmetrical shape about two perpendicular axes. Like the asymmetrical top, the asymmetrical base may also include a pair of corresponding halves defined by a longitudinal axis. As described above, the right half has a convex shape to cradle the small of the golfer's back and the left half is concave to provide increased area for a pocket, such as a clothing pocket or ball pocket. In addition, the golf bag base may include an off center, bi-planar cut away portion including two intersecting planes coupled by a radius to facilitate engagement of the off center mounted stand mechanism.

BRIEF DESCRIPTION OF THE DRAWINGS

The present invention is illustrated by way of example, and not by way of limitation, in the figures of the accompanying drawings and in which like reference numerals refer to similar elements and in which.

DETAILED DESCRIPTION

A new, light weight, asymmetrical golf bag is described. In the following description, for the purposes of explanation, specific details are set forth in order to provide a thorough understanding of the present invention. It will be apparent, however, to one skilled in the art that the present invention may be practiced without some of these specific details.

Figure 1A:
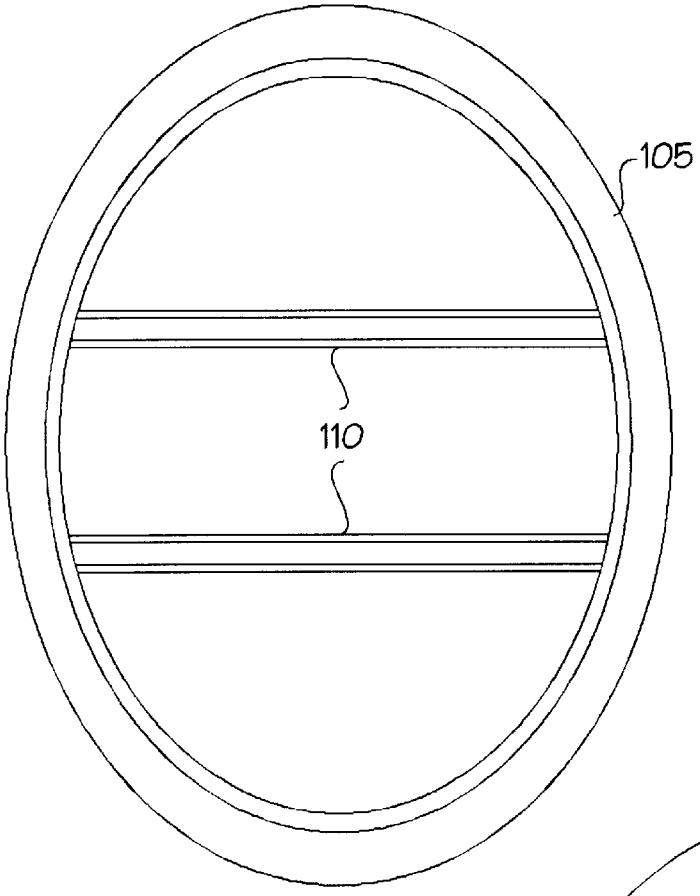
Fig. 1a (Prior Art)
FIGS. 1A and 1B are top views of exemplary prior art golf bag tops.
Figure 1B:
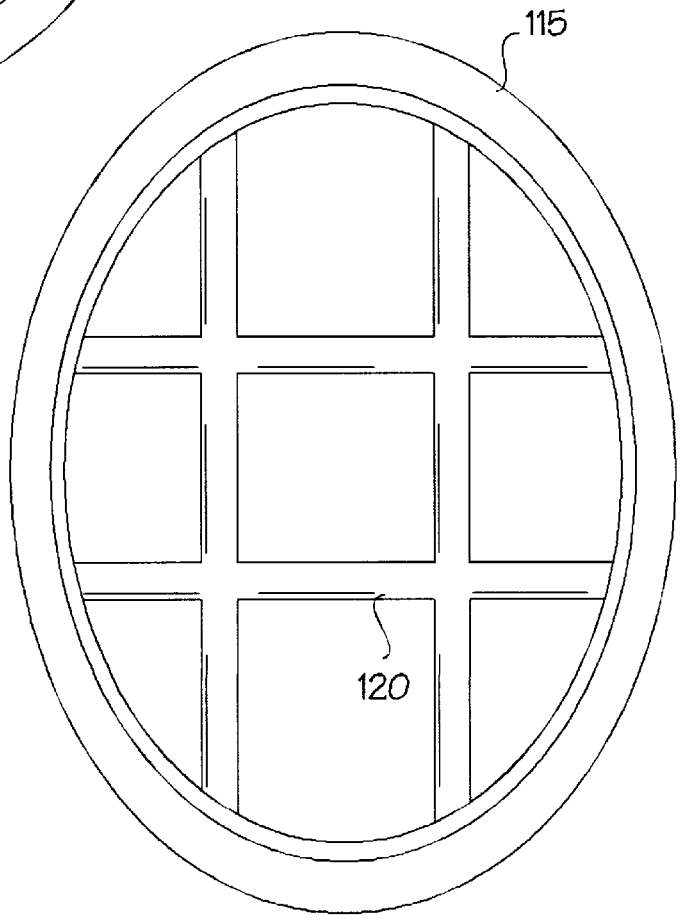
Fig. 1b (Prior Art)
Figure 2A:
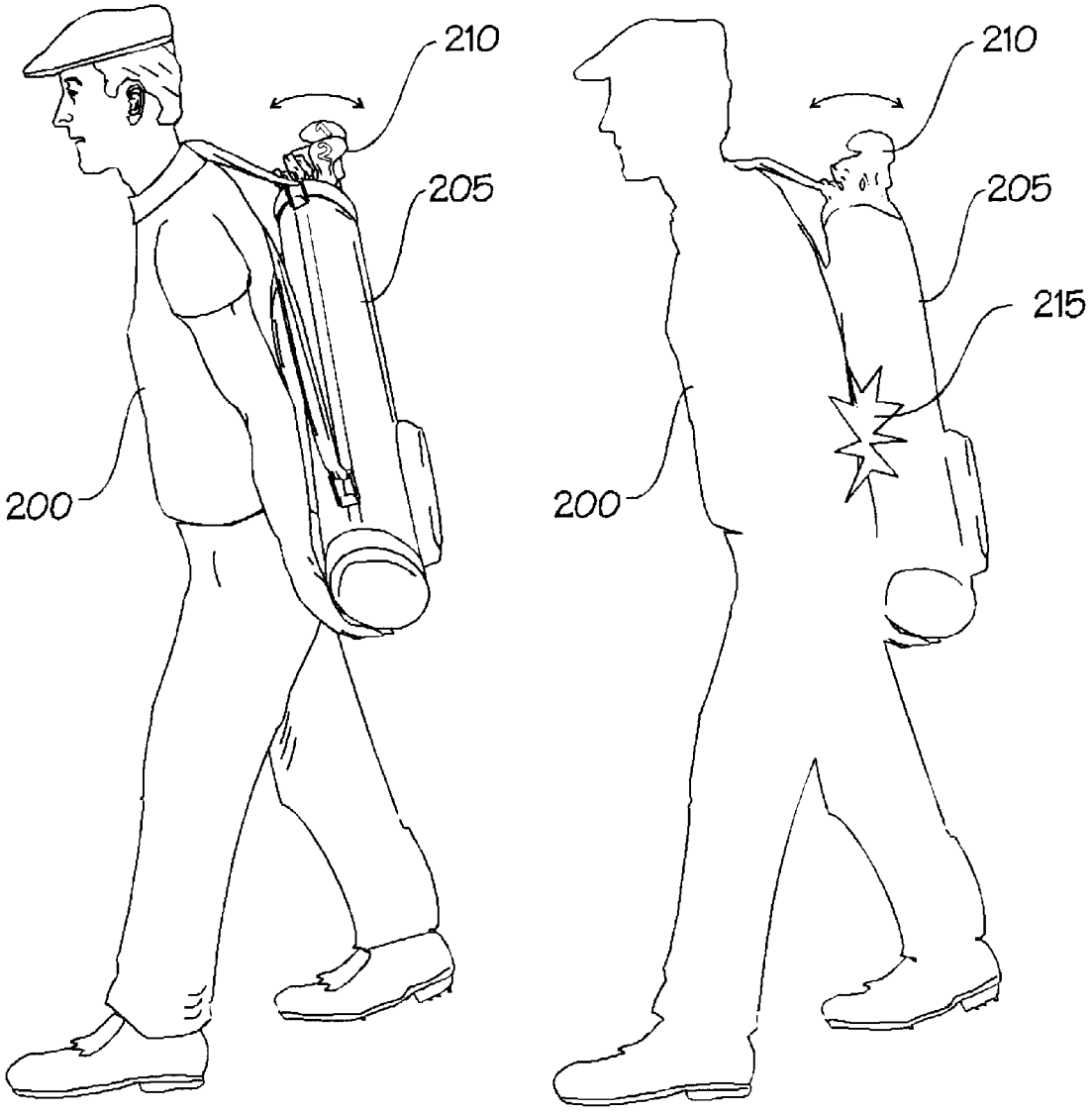
Fig. 2A (Prior Art)
FIGS. 2A and 2B illustrate a golfer carrying a prior art stand bag.
Figure 2B:
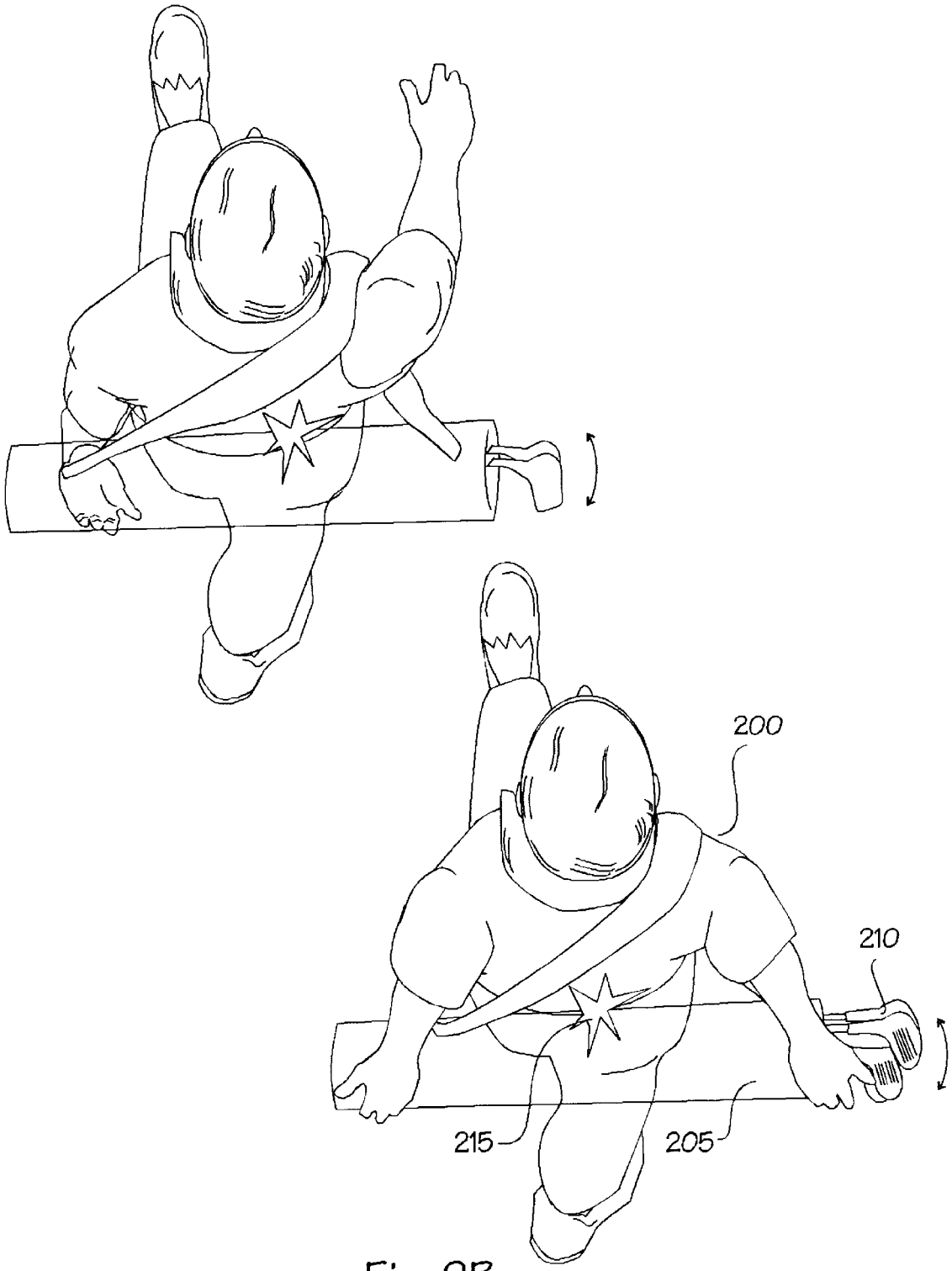
Fig. 2B (Prior Art)
Figure 3:
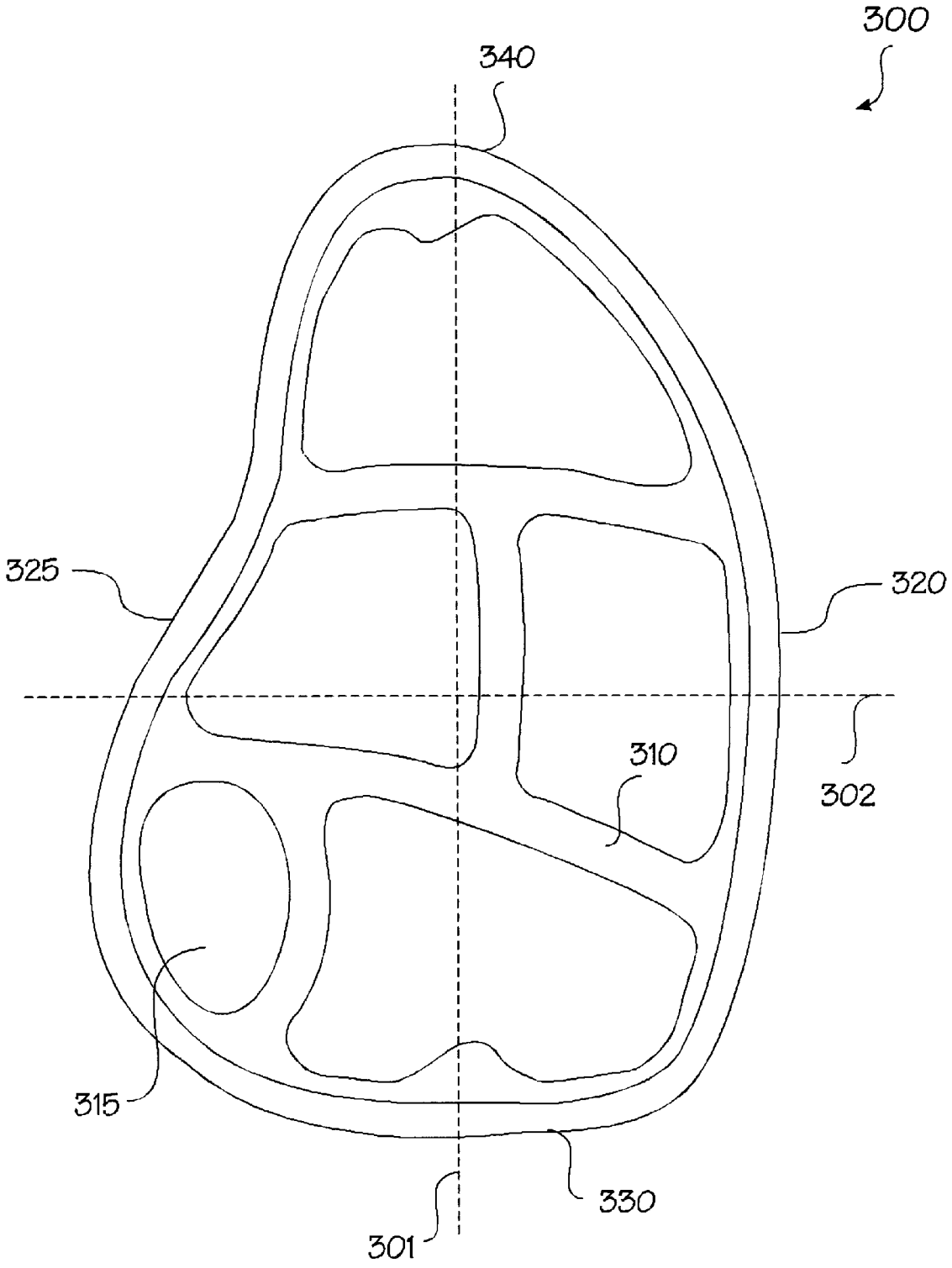
FIG. 3 is a top view of a golf bag top according to one embodiment of the present invention.

Referring to FIG. 3 a top view of an exemplary asymmetrical golf bag top 300 is illustrated. In the embodiment depicted, the golf bag top 300 includes a pocket side 325, a back side 320, a top side 340, a bottom side 330, a plurality of integral divider bars 310, and a putter well 315. In a broad sense, one feature of the present embodiment is the fact that the golf bag top 300 has an asymmetrical shape about two perpendicular axes. Corresponding sides 320 and 325 defined by a longitudinal axis 301 are not symmetrical nor are the corresponding sides 340 and 330 which are defined by a lateral axis 302 perpendicular to the longitudinal axis 301. In freeing itself of the traditional notion that a golf bag should be symmetrical, the assignee of the present invention has been able to develop a more intelligent and useful shape for a golf bag top 300.

In the embodiment depicted, the pocket side 325 has a concave shape. The concavity provides a pocket, such as a clothing pocket, a ball pocket, or the like, with more space. In alternative embodiments, the pocket side 325 may have more or less of an indent and the corners may be rounded or sharp.

The back side 320 is on the side of the golf bag 405 that is adjacent to the golfer's back when the golf bag 405 is being carried over one or both shoulders with a single or dual strap, respectively. In the embodiment depicted, the back side 320 has a convex shape that is sculpted to comfortably cradle the small of a golfer's back. It is appreciated that various other convex shapes may be employed. Equivalent shapes and colorable imitations thereof will be evident to a person of ordinary skill in the art; therefore, the asymmetrical shape depicted in FIG. 3 should be viewed as merely one example of an asymmetrical top.

According to this example, the divider bars 310 have a negative slope with respect to the horizontal. That is, the divider bars 310 slope downwardly toward the bottom side 330 from the pocket side 325 to the back side 320. As will be discussed further below, the downward slope of the divider bars 310 in combination with gravity urge the clubs 420 to gather close to the golfer's back and remain there. Advantageously, the sloshing and movement of the clubs 420 and golf bag 405 is thereby reduced and the golf bag 405 stays snug against the golfer's back.

Figure 4A:
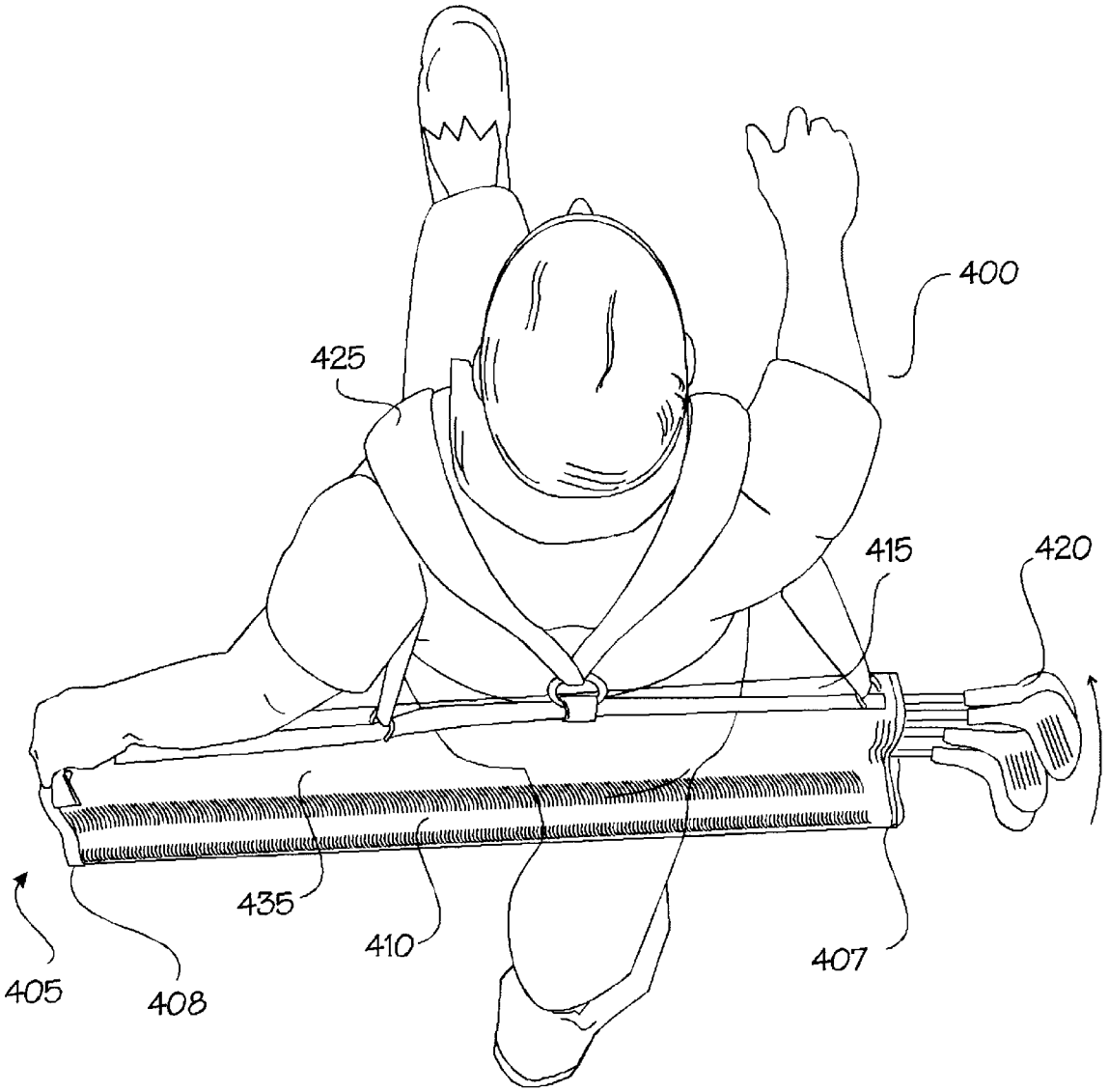
FIGS. 4A and 4B illustrate a golfer carrying an asymmetrical golf bag according to one embodiment of the present invention.
Figure 4B:
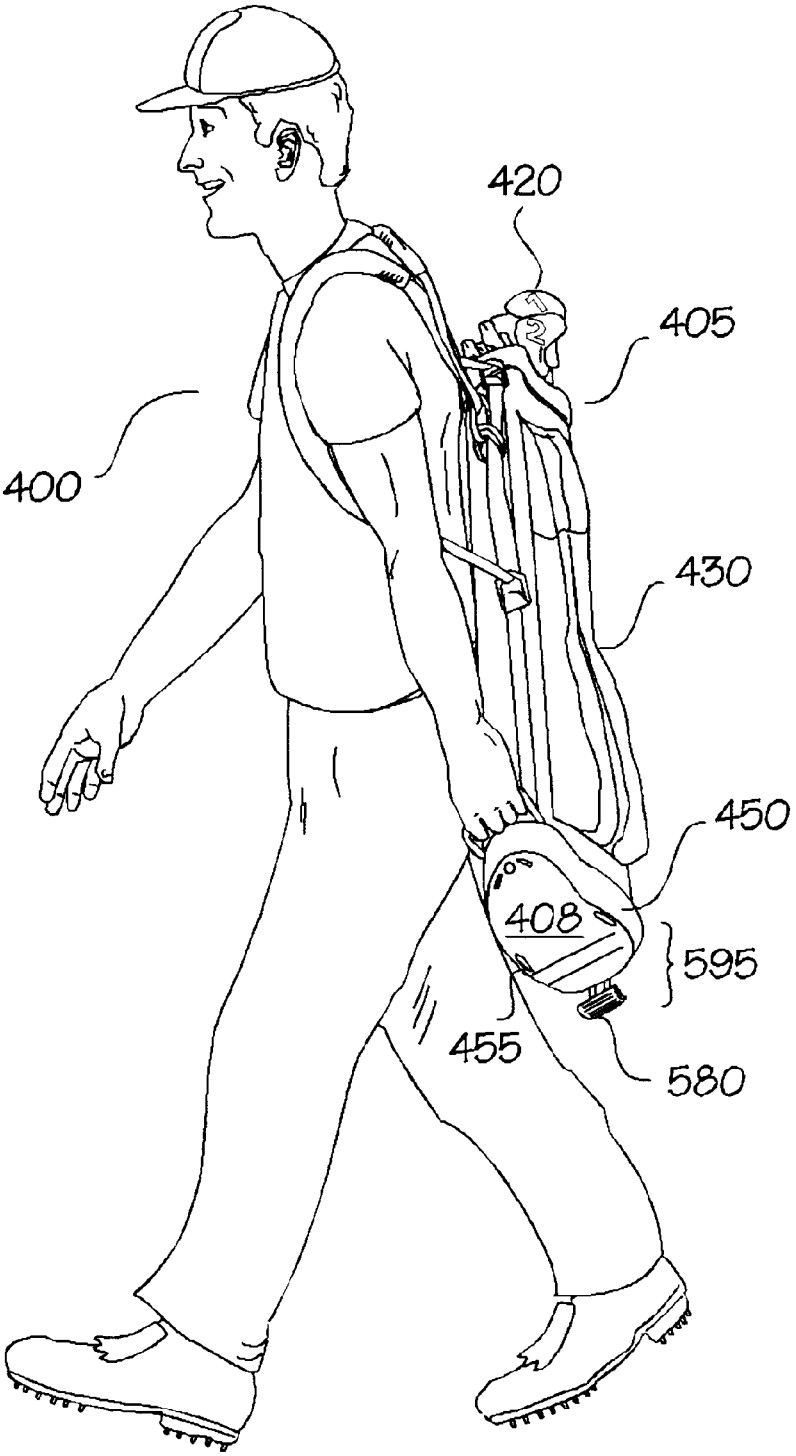

When an asymmetrical golf bag 405 including an asymmetrical golf bag top 300 is carried, as depicted in FIGS. 4A and 4B, the top side 340 is furthest from the ground, the bottom side 330 is closest to the ground, the concave-shaped pocket side 325 is positioned away from the golfer's back, and the convex-shaped back side 320 is adjacent to the golfer's back.

FIGS. 4B and 4A illustrate a golfer 400 carrying an exemplary asymmetrical golf bag 405 with and without a clothing pocket 430 attached, respectively. In these illustrations, the golf bag 405 includes a top 407, a base 408, a body 435, and a dual strap 425. Like the top 300, described above, the golf bag body 435 has a convex-shaped back side 415 and a concave pocket side 410. Similarly, the base 408 has a concave side 450 corresponding the concave sides of the top 407 and golf bag body 435 and a convex side 455 corresponding to the convex sides of the top 407 and golf bag body 435. The base 408 additionally includes an off center located cut away portion 595 which will be described further below.

While the currently preferred embodiment comprises both an asymmetrical top 407 and an asymmetrical base 408 having substantially the same shape, it is appreciated that various combinations of symmetrical and asymmetrical parts may be employed. For example, an asymmetrical top 407 may be matched up with a symmetrical base (not shown) or a symmetrical top (not shown) may be matched with an asymmetrical base 408.

Figure 5A:
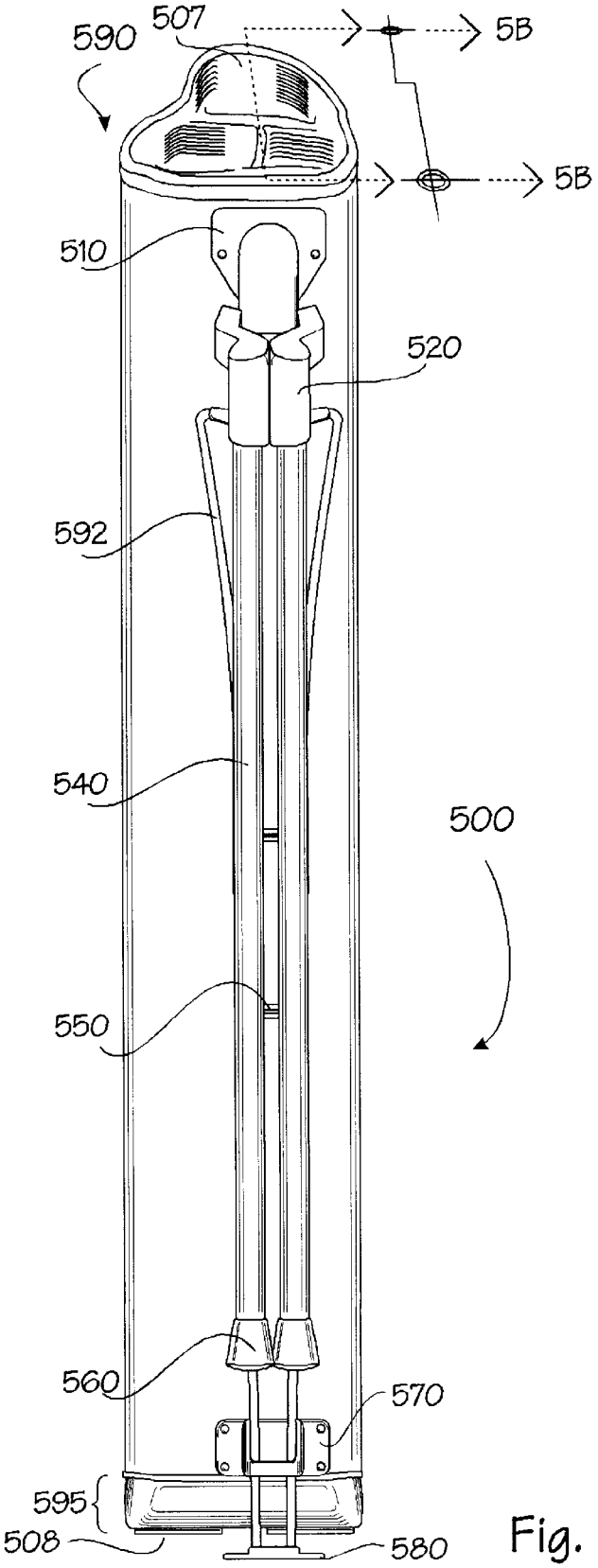
FIG. 5A is a stand-side view of an asymmetrical golf bag according to one embodiment of the present invention.
Figure 5B:
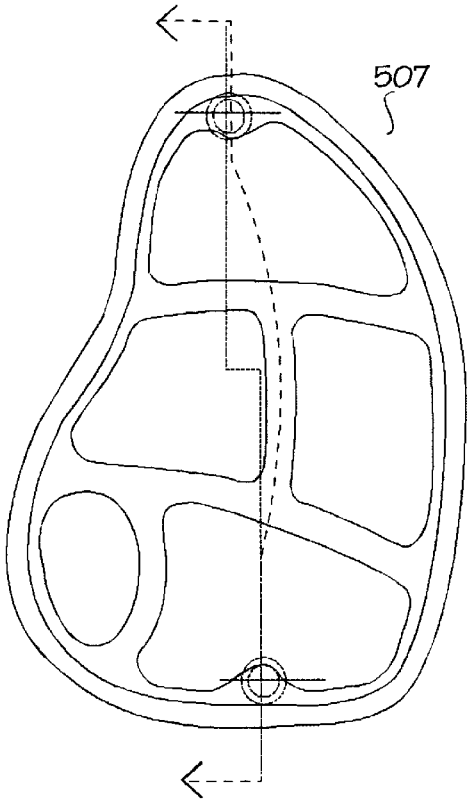
FIG. 5B is a sectional view of the top of the asymmetrical golf bag of FIG. 5A.

Referring now to FIG. 5A, a stand-side view of an asymmetrical golf bag 590 according to one embodiment of the present invention is depicted. According to the embodiment depicted, the stand 500 comprises a top bracket 510, a pair of femurs 520, a wire form 592, a clip 550, a pair of legs 540, a pair of feet 560, a guide 570, and a footplate 580. While the golf bag 590 is in an upright vertical position or being carried, for example, the legs 540 of the stand 500 remain in their retracted (inoperative) state as illustrated by FIG. 5A. However, when the golf bag 590 is set down, during club selection and/or club replacement, for example, and the footplate 580 is actuated by the weight of the golf bag 590, the legs 540 are shifted into their extended (operative) position as illustrated by FIG. 6D. As the specific stand mechanism employed is not central to the present invention, no further details will be described. Numerous types of wire form stands are well known in the art. It will be appreciated that certain prior wire form stands and other types of stands may be used in connection with the asymmetrical golf bag 590. According to one embodiment, the asymmetric golf bag 590 may employ the stand assembly described in a copending U.S. patent application Ser. No. 08/925,243 entitled "Low Profile Golf Bag Stand Assembly," of Chloe Sundara et. al., and assigned to the assignee of the present invention.

What is important to point out at this time is the positioning of the stand 500 relative to a centerline, a vertical line drawn down the center of the stand-side of the golf bag 590. For a conventional symmetrical golf bag, the stand 500 is mounted such that the stand hardware is symmetrical about the centerline. For example, one of the pair of legs 540 would lie on each side of the centerline, one of each of the pair of femurs 520 would lie on each side of the centerline, etc. In contrast, in the embodiment depicted, the stand 500 is mounted asymmetrically about the centerline. In this off center position, all or most of the stand hardware may be located right of the centerline. As will be discussed further below, if the base employed includes an off center cut away portion 595, then the stand position may be aligned so that the footplate 580 falls within the center of the cut away portion 595. Advantageously, together, the off center location of the cut away 595 in the base and the off center positioning of the stand 500 allow the stand 500 to be more easily engaged when the golf bag is being placed down from an over-the-shoulder carrying position as discussed further below. Various other off center positions are contemplated, for example, the mounting of the stand 500 and the cut away portion 595 of the base may also be positioned to the left of the centerline for a left-handed golf bag.

Figure 5C:
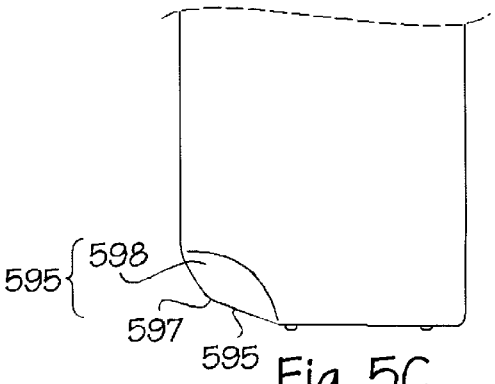
FIG. 5C is a side elevational view of the base of the asymmetrical golf bag of FIG. 5A.

FIG. 5C is a side elevational view of the base 508. According to the embodiment depicted, the base 508 includes cut away portion 595. In this example, the cut away portion 595 is a bi-planar cut away comprising two intersecting planes 596 and 598 connected by a radius 597. From an upright position, the cut away portion 595 of the base 508 facilitates actuation of the stand 500 by allowing the golfer or caddy to simply rock the golf bag 590 in the direction of the cut away portion 595 of the base 508 to cause the legs 540 to extend. Additionally, the cut away portion 595 of the base 508 is advantageous because it increases the throw of the legs 540. In the embodiment depicted, the off center mounting of the stand 500 is coordinated with the cut away portion's off center location to provide effortless engagement of the stand 500.

Figure 6B:
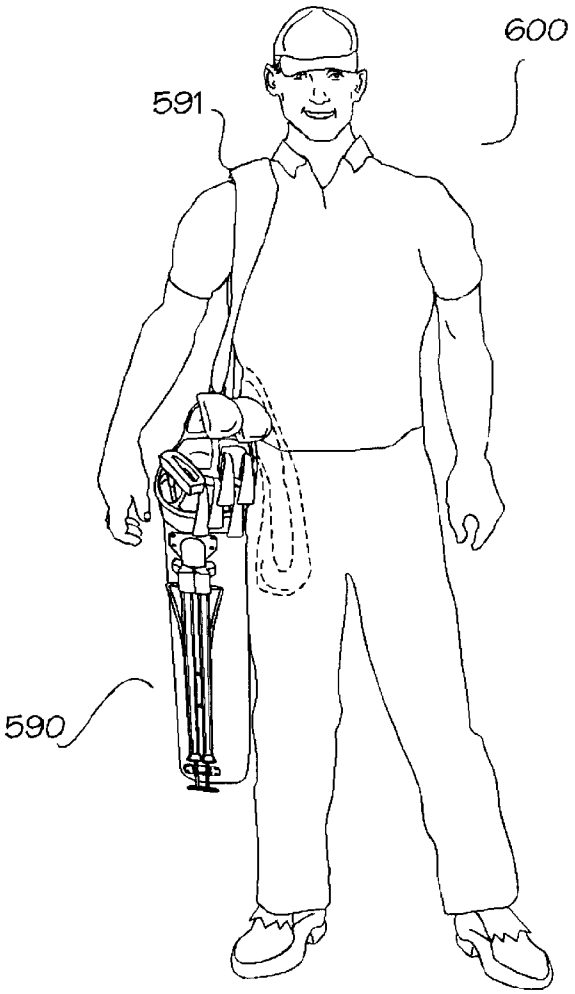
FIGS. 6A–6D illustrate how an off center position of a cut away portion of the base and an off center mounting of the stand may facilitate actuation of the stand according to one embodiment of the present invention.
Figure 6A:
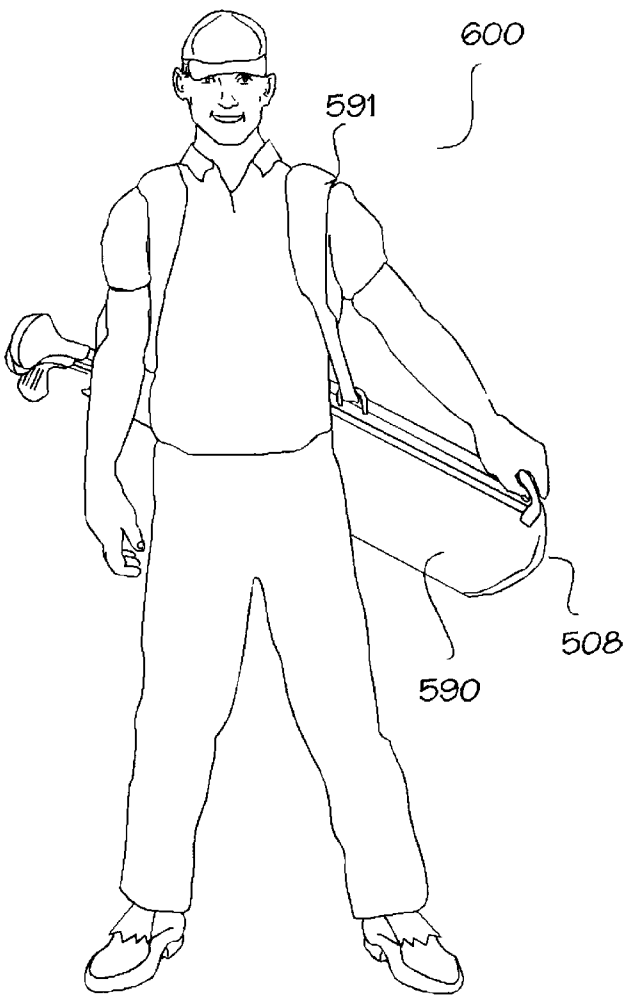
Figure 6D:
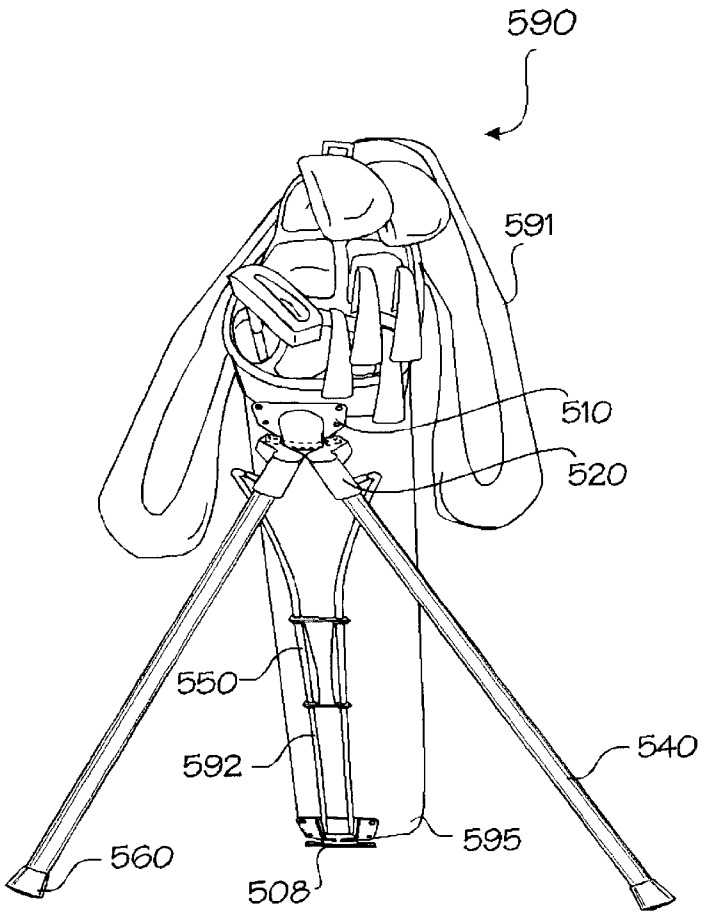
Figure 6C:
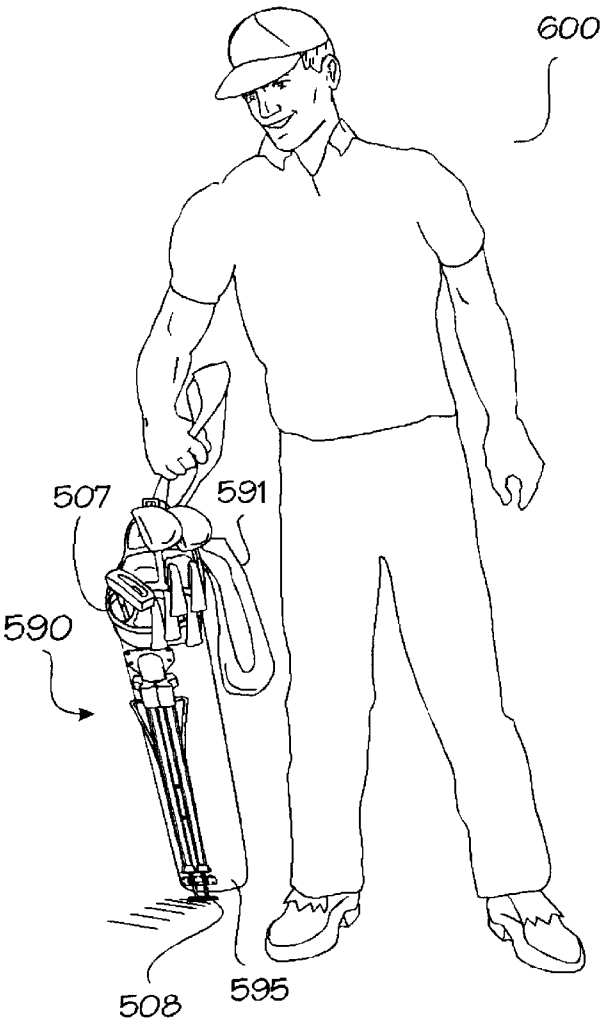

FIGS. 6A–6D illustrate off center actuation of the stand 500 according to one embodiment of the present invention. In FIG. 6A, a golfer 600 is depicted carrying the golf bag 590 with a dual strap 591. In FIG. 6B, the golfer 600 has removed a first strap of the dual strap 591 and the golf bag 590 has been lowered to the golfer's right side. In FIG. 6C, the golfer 600 has removed the second strap of the dual strap 591. As described above, while the golf bag 590 is being carried the clubs are drawn to the right side of the top 507. Therefore, as the golf bag 590 is lowered to the ground, the first portion of the base 508 to contact the ground is the side of the base 508 with the cut away portion 595. Consequently, simply removing the golf bag 590 from an over-the-shoulder position and lowering it to the ground engages the footplate 580 and actuates the stand 500. Advantageously, in this manner, the coordinated off center positioning of the cut away portion 595 of the base 508 and the off center mounting of the stand 500 in addition to the slope of the divider bars provide an effortless means of actuating the stand 500.

FIG. 6D shows the golf bag with the stand 500 in its extended position. The legs 540 are spaced apart from the golf bag 590 and oriented at an angle to each other thereby forming a tripod in connection with the golf bag 590 to support the golf bag 590 at a predetermined angle relative to the vertical. Preferably, the predetermined angle is such that the golf bag 590 is stable and clubs can be conveniently removed and replaced from the golf bag 590.

ALTERNATIVE EMBODIMENTS

Many alternative embodiments are contemplated by the inventors of the present invention. For example, the novel divider bars having a slope that encourages the golf clubs to settle next to the golfer's back may be included in a top with a symmetrical external shape. Additionally, in other embodiments, the top and/or base may be asymmetrical with respect to only one axis. Moreover, it will be appreciated that the divider bars may be excluded from the top or rearranged to achieve the desired weight distribution of the clubs in many different ways.

Also, many different materials may be used for the top, base, and body of the golf bag for various implementations while still providing the advantages described above. These materials may include polypropylene, santoprene, PE, PU, fur, wood, foam, and other flexible and rigid materials.

Finally, while in various embodiments a dual strap is depicted, the advantages described above are equally applicable when either a single or a dual strap is employed.

In the foregoing specification, the invention has been described with reference to specific embodiments thereof. It will, however, be evident that various modifications and changes may be made thereto without departing from the broader spirit and scope of the invention. The specification and drawings are, accordingly, to be regarded in an illustrative rather than a restrictive sense.

What is claimed is:

1. A golf bag comprising:

a top located at an upper portion of the golf bag and through which a golf club may be inserted;

a base located at a lower portion of the golf bag, the base has an asymmetrically shaped outline, the asymmetrically shaped outline comprising a pair of corresponding halves defined by a longitudinal axis of the base, a first of the corresponding halves curving inward to form a concave contour and a second of the corresponding halves curving outward to form a convex contour;

a body coupled between the top and the base, the body including a back-side, a pocket-side, a handle-side, and a stand-side, the back-side is opposite the pocket-side and adjacent to both the handle-side and the stand-side, and the handle-side is opposite the stand-side;

a stand mounted to the top and the base on the stand-side of the body at an off center position relative to a longitudinal axis that bisects the stand-side of the body; and wherein the base further includes a bottom surface having at least two intersecting planes, a first plane of the at least two intersecting planes is substantially perpendicular to the longitudinal axis of the body, a second plane of the at least two intersecting planes forms an angle of greater than 180 degrees with the first plane, and together the first and second plane define a cut-away portion in the stand-side of the base.

2. A golf bag comprising:

a top located at an upper portion of the golf bag and through which a golf club may be inserted;

a base located at a lower portion of the golf bag, the base has an asymmetrically shaped outline, the asymmetrically shaped outline comprising a pair of corresponding halves defined by a longitudinal axis, a first of the corresponding halves curving inward to form a concave contour and a second of the corresponding halves curving outward to form a convex contour;

a body coupled between the top and the base, the body including a back-side, a pocket-side, a handle-side, and a stand-side, the back-side is opposite the pocket-side and adjacent to both the handle-side and the stand-side, and the handle-side is opposite the stand-side;

a stand mounted to the top and the base on the stand-side of the body at an off-center position relative to a longitudinal axis that bisects the stand-side of the body; and wherein the base further includes a bottom surface having at least two intersecting planes, a first plane of the at least two intersecting planes is substantially perpendicular to the longitudinal axis of the body, a second plane of the at least two intersecting planes forms an angle of greater than 180 degrees with the first plane, together the first and second plane define a cut-away portion in the stand-side of the base, and the cut-away portion in the stand-side of the base is located at an off-center position corresponding to the off-center position of the stand.

3. A golf bag comprising:

a top located at an upper portion of the golf bag and through which a golf club may be inserted;

a base located at a lower portion of the golf bag, the base has an asymmetrically shaped outline, the asymmetrically shaped outline comprising a pair of corresponding halves defined by a longitudinal axis of the base, a first of the corresponding halves curving inward to form a concave contour and a second of the corresponding halves curving outward to form a convex contour;

a body coupled between the top and the base, the body including a back-side, a pocket-side, a handle-side, and a stand-side, the back-side is opposite the pocket-side and adjacent to both the handle-side and the stand-side, and the handle-side is opposite the stand-side;

a stand mounted to the top and the base on the stand-side of the body at an off-center position relative to a longitudinal axis that bisects the stand-side of the body.

* * * * *